US012490822B2

(12) United States Patent
Lee et al.

(10) Patent No.: US 12,490,822 B2
(45) Date of Patent: Dec. 9, 2025

(54) COSMETIC APPLICATOR WITH ADJUSTABLE APPLICATOR TIP

(71) Applicant: L'OREAL, Paris (FR)

(72) Inventors: Ji Lee, NY, NY (US); Guive Balooch, NY, NY (US)

(73) Assignee: L'Oreal, Paris (FR)

( * ) Notice: Subject to any disclaimer, the term of this patent is extended or adjusted under 35 U.S.C. 154(b) by 657 days.

(21) Appl. No.: 17/333,523

(22) Filed: May 28, 2021

(65) Prior Publication Data

US 2022/0378172 A1 Dec. 1, 2022

(51) Int. Cl.

| | |
|---|---|
| ***A45D 34/04*** | (2006.01) |
| ***A46B 5/00*** | (2006.01) |
| ***A46B 9/02*** | (2006.01) |

(52) U.S. Cl.

CPC ..... *A45D 34/042* (2013.01); *A46B 5/0079* (2013.01); *A46B 9/021* (2013.01); *A46B 2200/1053* (2013.01)

(58) Field of Classification Search

CPC ..... A45D 29/05; A45D 29/14; A45D 34/041; A45D 34/042; A45D 34/043; A45D 34/045; A45D 40/262; A45D 40/264; A45D 2040/0006; A45D 2040/0062; A45D 2040/208; A45D 2034/002; A45D 2034/043; A45D 40/20; A45D 40/205; A45D 40/265; A46B 17/02; B25G 1/06;

(Continued)

(56) References Cited

U.S. PATENT DOCUMENTS 1,379,536 A * 5/1921 Davies ..... B25G 1/066 81/157
1,407,341 A * 2/1922 Veeck ..... A46B 7/06 292/DIG. 16

(Continued)

FOREIGN PATENT DOCUMENTS

GB 806484 A 12/1958
JP 7-44410 U 11/1995

(Continued)

OTHER PUBLICATIONS

Nakajima, Nobuyuki, "JP-08229491-A—translated" (Year: 1996).*

(Continued)

*Primary Examiner* — Thomas C Barrett
*Assistant Examiner* — Holly T. To
(74) *Attorney, Agent, or Firm* — Christensen O'Connor Johnson Kindness PLLC

(57) ABSTRACT

An adjustable cosmetic applicator includes a stem; an applicator tip attached to a first end of the stem; a base attached to a second end of the stem, the base including a locking device disposed at a first end of the base, the locking device including a ball; a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, wherein the chamber and the handle are configured to rotate independently around a rotation axis through a center of the chamber and the handle.

12 Claims, 9 Drawing Sheets

(58) Field of Classification Search
CPC .. B25G 1/066; F16B 2/16; B25B 1/06; B25B 5/00; B25B 5/122
USPC ..... 132/320; 16/110.1, 422, 426; 15/231
See application file for complete search history.

(56) References Cited

U.S. PATENT DOCUMENTS 1,611,549 A * 12/1926 Moore ..... G05G 1/085 16/110.1
1,747,527 A * 2/1930 Peterson ..... B25B 13/08 81/57.32
2,357,865 A * 9/1944 Arbuckle ..... A45D 2/122 132/238
2,544,248 A * 3/1951 Ashmead ..... A45D 29/05 30/34.05
2,792,581 A * 5/1957 Woyton ..... A46B 17/02 403/162
2,899,966 A 8/1959 Skelton
2,981,968 A * 5/1961 Schaich ..... A45D 34/041 215/340
3,421,522 A * 1/1969 Magguilli ..... A45D 24/007 D28/24
3,773,094 A * 11/1973 Kuenzel ..... B25G 1/066 81/177.8
3,790,232 A * 2/1974 Alvarez ..... F16B 9/058 403/317
3,991,776 A * 11/1976 Duffy ..... A45D 44/18 132/311
4,428,388 A * 1/1984 Cassai ..... A46B 9/021 D28/7
4,747,419 A * 5/1988 Flynn ..... B43K 5/1845 132/73
4,946,440 A * 8/1990 Hall ..... A61M 16/0833 606/7
4,961,443 A * 10/1990 Buccicone ..... F16K 31/607 137/315.15
5,086,793 A * 2/1992 Kingsford ..... A46B 7/02 132/218
5,096,320 A * 3/1992 Norman ..... A45D 34/045 401/129
5,279,206 A * 1/1994 Krantz ..... F16H 61/42 91/219
5,298,844 A * 3/1994 Nagasaki ..... B23Q 1/5481 318/578
RE34,680 E * 8/1994 Lieser ..... B25B 13/462 81/59.1
5,492,136 A * 2/1996 Edmonds ..... A45D 2/48 132/218
5,592,714 A * 1/1997 Bernard ..... A45D 34/041 15/144.3
5,649,777 A * 7/1997 Holloway ..... A45D 40/16 401/74
5,699,810 A * 12/1997 Pallikaris ..... A61F 9/013 128/898
5,781,955 A * 7/1998 Hendricks ..... B24B 23/02 15/22.1
5,853,210 A * 12/1998 Robinson ..... A46B 5/025 2/160
5,862,715 A * 1/1999 Lemire ..... H01H 19/11 74/553
5,937,871 A * 8/1999 Clay ..... A45D 40/265 132/218
5,992,423 A * 11/1999 Tevolini ..... A45D 20/525 15/176.1
6,009,887 A * 1/2000 Hertel ..... A45D 34/042 132/320
6,067,724 A * 5/2000 Depoyian ..... A45D 20/12 392/383
6,145,514 A * 11/2000 Clay ..... A46B 13/001 132/218
RE37,190 E * 5/2001 Stowell ..... B25G 1/10 473/549
6,230,716 B1 * 5/2001 Minoletti ..... A45D 6/04 132/226
6,237,194 B1 * 5/2001 Williams ..... A61F 4/00 30/298
6,241,408 B1 * 6/2001 Lang ..... A45D 40/24 132/297
6,289,557 B1 * 9/2001 Manson ..... E05B 1/0053 16/904
6,397,708 B1 * 6/2002 Hung ..... B25G 1/066 81/177.8
6,450,178 B1 9/2002 Clay
6,524,238 B2 * 2/2003 Velikaris ..... A61B 17/02 16/422
6,530,709 B1 * 3/2003 Washington ..... A45D 34/042 401/278
6,612,628 B1 * 9/2003 Herbst ..... E05C 17/34 16/334
6,614,534 B1 * 9/2003 Marcus ..... G01B 11/0675 356/497
6,813,993 B1 * 11/2004 Liu ..... A47J 37/0786 99/421 A
6,824,339 B1 * 11/2004 Childers ..... B61D 45/00 16/110.1
6,901,827 B1 * 6/2005 Yen ..... B25B 23/0035 81/177.85
6,953,196 B1 * 10/2005 Huang ..... B25B 23/0035 81/177.85
6,968,760 B2 * 11/2005 Hu ..... B25G 1/085 81/492
6,971,143 B2 * 12/2005 Domroese ..... A61M 60/109 16/441
7,174,818 B1 * 2/2007 Cutler ..... B25B 23/1427 81/478
7,178,247 B2 * 2/2007 Currie ..... A47G 21/02 414/9
7,287,450 B1 * 10/2007 Liao ..... B25B 15/02 81/177.9
7,356,867 B1 * 4/2008 Beiermann ..... B08B 1/34 15/23
7,481,592 B2 * 1/2009 Gueret ..... A46B 9/005 401/122
8,132,977 B2 * 3/2012 Pires ..... A45D 40/06 401/88
8,261,398 B2 * 9/2012 Haigh ..... A46B 5/0095 15/176.1
8,407,853 B1 * 4/2013 Baxt ..... A47L 9/0693 15/394
8,985,883 B2 * 3/2015 Wyatt ..... A46B 13/02 132/218
9,156,146 B1 * 10/2015 Maceo ..... B25B 23/0007
9,237,799 B1 * 1/2016 Manning, Jr. ..... A46B 17/02
9,462,871 B2 * 10/2016 Machiorlette ..... A45D 33/36
9,573,195 B2 * 2/2017 Schneider ..... B23B 31/1071
10,076,173 B1 * 9/2018 Kaidi ..... A45D 29/02
10,398,215 B2 9/2019 Kim et al.
10,610,005 B2 * 4/2020 Kim ..... A46B 9/021
10,959,509 B1 * 3/2021 Conner ..... A46B 3/18
11,234,505 B2 * 2/2022 Di Mella ..... A46B 5/0095
11,260,520 B2 * 3/2022 Anderson ..... A61B 17/54
11,357,308 B1 * 6/2022 Liu ..... A45D 40/00
11,400,627 B2 * 8/2022 Jungnickel ..... A46B 5/0095
2001/0052353 A1 * 12/2001 Brumlik ..... G09F 7/12 134/8
2002/0098216 A1 * 7/2002 Nadel ..... A45D 40/18 401/88
2002/0117592 A1 * 8/2002 Traylor ..... B44D 3/123 248/231.71
2003/0064350 A1 * 4/2003 Rubinstenn ..... A61B 5/444 434/99
2003/0084759 A1 * 5/2003 Carini ..... B25G 1/046 81/492
2003/0192564 A1 * 10/2003 Johnson ..... A45D 24/007 132/148
2003/0204926 A1 * 11/2003 Jurgens ..... B25G 3/30 15/144.3

(56) References Cited

U.S. PATENT DOCUMENTS

2003/0208863 A1* 11/2003 Green ..... A61C 17/3418 15/22.1
2004/0016073 A1* 1/2004 Knutson ..... A46B 5/0095 15/176.1
2004/0031287 A1* 2/2004 Leason ..... A44C 15/0015 63/1.13
2004/0250378 A1* 12/2004 Tontz, Sr. ..... B25G 1/066 16/110.1
2005/0076931 A1* 4/2005 Leung ..... A45D 2/00 132/200
2005/0123286 A1* 6/2005 Lok ..... A45D 2/367 392/385
2005/0273951 A1* 12/2005 Karl ..... A61C 17/22 15/176.1
2006/0009719 A1* 1/2006 LaJoie ..... A61H 7/005 601/72
2006/0037970 A1* 2/2006 Fazzio ..... A61L 9/035 222/145.1
2006/0076464 A1* 4/2006 Van ..... F16M 11/18 248/122.1
2006/0118039 A1* 6/2006 Cooper ..... B05B 12/12 118/696
2006/0144195 A1* 7/2006 Tanga ..... B25G 3/06 81/20
2006/0228157 A1* 10/2006 Dieudonat ..... A45D 40/265 401/126
2006/0233588 A1* 10/2006 Gueret ..... A45D 40/268 401/5
2006/0272667 A1* 12/2006 Wyatt ..... A46B 13/00 132/218
2006/0272668 A1* 12/2006 Wyatt ..... A45D 34/04 132/218
2007/0089686 A1* 4/2007 Drelinger ..... A01K 13/00 119/609
2007/0151059 A1* 7/2007 Petner ..... A47L 13/24 15/145
2008/0087296 A1* 4/2008 Gueret ..... A46B 5/04 222/196
2008/0087297 A1* 4/2008 Rahbar-Dehghan ..... B08B 1/00 134/1
2008/0196735 A1* 8/2008 Wyatt ..... A45D 40/265 132/218
2008/0296866 A1* 12/2008 Martin ..... B62B 5/06 280/304.5
2009/0049630 A1* 2/2009 Haigh ..... A46B 5/0095 53/396
2010/0017986 A1* 1/2010 Schiesz ..... A46B 5/02 29/428
2010/0115722 A1* 5/2010 Malloy ..... A46B 5/0016 15/114
2010/0186771 A1* 7/2010 Rahbar-Dehghan ..... B08B 6/00 15/160
2010/0212682 A1* 8/2010 Pires ..... A46B 15/0002 132/218
2010/0252058 A1* 10/2010 Rehkemper ..... A45D 29/00 132/73
2011/0005359 A1* 1/2011 Su ..... B25B 23/0028 81/177.7
2011/0061673 A1* 3/2011 Yahnker ..... A45D 1/10 132/232
2011/0126379 A1* 6/2011 Huang ..... A45B 3/04 16/110.1
2011/0162168 A1* 7/2011 Peluso ..... B25F 5/021 16/110.1
2011/0232039 A1* 9/2011 Hamilton ..... H01H 3/08 16/427
2011/0258809 A1* 10/2011 Lin ..... B25G 1/066 16/110.1
2012/0117743 A1* 5/2012 Yang ..... B25G 1/06 15/231
2012/0125362 A1* 5/2012 Irving ..... A45D 40/24 132/314
2013/0014338 A1* 1/2013 Park ..... A46B 5/0095 15/176.1
2013/0206156 A1* 8/2013 Salo ..... A45D 29/11 132/73
2013/0209155 A1* 8/2013 Hilton Dunne .... A46B 15/0093 401/6
2013/0223914 A1* 8/2013 Duru ..... A45D 34/00 401/172
2013/0223915 A1* 8/2013 Simonian ..... A45D 40/265 401/129
2014/0007897 A1* 1/2014 Huang ..... A45D 40/265 132/218
2014/0059792 A1* 3/2014 Naccour ..... B25G 3/04 15/160
2014/0219708 A1* 8/2014 Knight ..... A46B 5/0083 403/53
2015/0007404 A1* 1/2015 Prosser ..... A46B 5/0075 403/104
2015/0107034 A1* 4/2015 Shani ..... A46B 15/0006 15/22.1
2015/0165179 A1* 6/2015 Grez ..... A61M 35/003 604/310
2015/0336421 A1* 11/2015 Neubauer ..... G09B 19/00 434/335
2016/0022008 A1* 1/2016 Rabe ..... A61K 8/19 132/320
2016/0058150 A1* 3/2016 Yu ..... A45D 1/28 132/211
2016/0128457 A1* 5/2016 Lim ..... A46B 9/021 401/118
2016/0316887 A1* 11/2016 Maehr ..... A45D 40/18
2016/0324306 A1* 11/2016 Martin ..... A46B 9/021
2017/0014986 A1* 1/2017 Chou ..... A01B 1/16
2017/0027798 A1* 2/2017 Wersland ..... A61H 1/00
2017/0071320 A1* 3/2017 Shing ..... A45D 8/36
2018/0055205 A1* 3/2018 Pires ..... A45D 40/267
2018/0184795 A1* 7/2018 Pai ..... A46B 15/0038
2018/0249812 A1* 9/2018 Kim ..... A46B 5/0087
2018/0264245 A1* 9/2018 Edwards ..... A61N 2/002
2018/0344497 A1* 12/2018 Pathak ..... A61B 5/6825
2019/0082932 A1* 3/2019 Schoonbaert ..... A61B 1/00052
2019/0098974 A1* 4/2019 Grez ..... A45D 24/26
2019/0104822 A1* 4/2019 Martinez ..... A45D 26/0028
2019/0111557 A1* 4/2019 Kemp ..... B25G 1/04
2019/0191850 A1* 6/2019 Yoganandan ..... B26B 21/4056
2019/0308310 A1* 10/2019 Gusack ..... B25G 1/04
2020/0069032 A1* 3/2020 Dempsey ..... A45D 40/264
2020/0085168 A1* 3/2020 Pang ..... A61H 1/0285
2020/0086474 A1* 3/2020 Avalos ..... B25B 23/16
2020/0154954 A1* 5/2020 Mesue ..... A47K 7/022
2020/0245738 A1* 8/2020 Bell, Jr. ..... A46B 7/04
2020/0260860 A1* 8/2020 Machiorlette ..... A45D 33/36
2020/0383457 A1* 12/2020 Park ..... A45D 40/265
2020/0397131 A1* 12/2020 Maurin ..... A45D 33/00
2021/0070339 A1* 3/2021 Delgatty ..... B60N 3/104
2021/0120947 A1* 4/2021 Machiorlette ..... A46B 9/10
2021/0187765 A1* 6/2021 Truong ..... A45D 34/04
2021/0220045 A1* 7/2021 Rajagopalan ..... A61B 17/3478
2021/0282632 A1* 9/2021 Hu ..... A46B 9/04
2021/0394453 A1* 12/2021 Lalonde ..... G06F 30/10
2022/0031229 A1* 2/2022 Lewis ..... A45D 44/00
2022/0095775 A1* 3/2022 Lee ..... A46B 5/025
2022/0174242 A1* 6/2022 Culver, II ..... H04N 7/183
2022/0178744 A1* 6/2022 Kosecoff ..... H04Q 9/00
2022/0266527 A1* 8/2022 Negugogor ..... G06F 30/20
2023/0054573 A1* 2/2023 Passafiume ..... A47L 25/00
2023/0165363 A1* 6/2023 Leonard ..... A46D 1/0207 132/200
2023/0191585 A1* 6/2023 Cobián-Méndez ..... A47L 13/38 81/489
2023/0301415 A1* 9/2023 Soresina ..... A45D 20/12 34/97

(56) References Cited

U.S. PATENT DOCUMENTS

| | | | | |
|---|---|---|---|---|
| 2024/0216159 | A1* | 7/2024 | Barbarino | A45D 34/04 |
| 2024/0315438 | A1* | 9/2024 | Stahl | A46B 15/0051 |

FOREIGN PATENT DOCUMENTS

| | | | | | |
|---|---|---|---|---|---|
| JP | 08229491 | A | * | 9/1996 | A45D 34/042 |
| KR | 20-0335636 | Y1 | | 12/2003 | |
| WO | WO 2010/125188 | A1 | | 11/2010 | |

OTHER PUBLICATIONS

International Search Report and Written Opinion issued Sep. 6, 2022 in PCT/US2022/030625, 17 pages.

French Preliminary Search Report and Written Opinion issued Mar. 31, 2022 in French Patent Application No. 2107241 (with English translation of Category of Cited Documents), 10 pages.

"Helping people with hand tremor or limited hand and arm mobility to eat with confidence and independence", Liftware by Verily, Verily Life Sciences, https://verily.com/solutions/liftware/, May 26, 2021, 8 pages.

Korean Office Action mailed Jan. 23, 2025, issued in related Korean Application No. 10-2023-7038905 filed Nov. 10, 2023, 18 pages.

* cited by examiner

COSMETIC APPLICATOR WITH ADJUSTABLE APPLICATOR TIP

BACKGROUND

Field of the Invention

The application generally relates to an apparatus including a rotateable applicator tip, a rotation of the applicator tip being resisted via a plurality of detents.

SUMMARY

In an embodiment, the present disclosure relates to an adjustable cosmetic applicator, including a stem; an applicator tip attached to a first end of the stem; a base attached to a second end of the stem, the base including a locking device disposed at a first end of the base, the locking device including a ball; a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, wherein the chamber and the handle are configured to rotate independently around a rotation axis through a center of the chamber and the handle.

In an embodiment, the present disclosure additionally relates to an adjustable cosmetic applicator, including a stem; an applicator tip attached to a first end of the stem; a base attached to a second end of the stem, the base including a locking device disposed at a first end of the base, the locking device including a ball; a handle including an exterior surface, the exterior surface of the handle including a plurality of detents configured to receive the ball; and a hollow chamber rotateably coupled to the exterior surface of the handle along a portion of the exterior surface including the plurality of detents, wherein the chamber and the handle are configured to rotate independently around a rotation axis through a center of the chamber and the handle.

In an embodiment, the present disclosure additionally relates to an adjustable cosmetic applicator adapter, including a handle including an exterior surface, the exterior surface of the handle including a plurality of detents configured to receive a ball, the handle being configured couple to a cosmetic applicator and rotate the cosmetic applicator; and a hollow chamber rotateably coupled to the exterior surface of the handle along a portion of the exterior surface including the plurality of detents, wherein the chamber and the handle are configured to rotate independently around a rotation axis through a center of the chamber and the handle.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
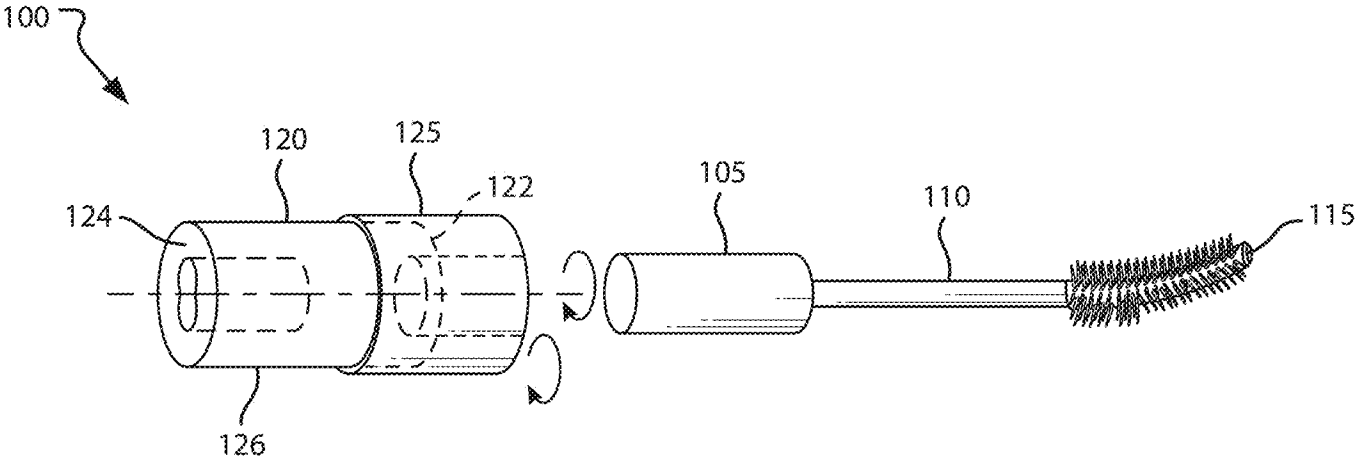
FIG. 1A is a schematic of an adjustable cosmetic applicator, according to an embodiment of the present disclosure.

A cosmetic applicator can be used to apply a cosmetic fluid onto a user's skin. Makeup applicators, such as lip gloss brushes, can include directional features. This can take the form of, for example, a directional applicator tip. That is, a flocked tip, sponge tip, or brush tip (the part that delivers formula to a user's skin) can be not symmetrical and include, for example, a flat portion for contacting the user's skin. Thus, the application of the cosmetic fluid may perform more optimally in a predetermined specific direction with the applicator tip's flat portion being tangent to a surface of the user's skin. This directionality of the applicator tip may not accommodate for limited mobility of specific target users such as those affected by limited arm/hand mobility. Therefore, a cosmetic device including an adjustable applicator tip is desired.

Described herein, an adapter connects a makeup applicator brush to a motion stabilizing handle including a rotating element with detents so the user is able to adjust the directional brush to fit their ability and movement.

Referring now to the figures, FIG. IA is a schematic of an adjustable cosmetic applicator 1 00, according to an embodiment of the present disclosure. In an embodiment, the adjustable cosmetic applicator 100 may be used for a variety of cosmetic applications, including, in a non-limiting example, lip gloss, mascara, eyebrow applications, liners, foundation applications, skin pads, and hair cosmetic applications and/or brushes. As shown, the adjustable cosmetic applicator 100 includes a base 105, a stem 110, an applicator tip 115, a handle 120, and a chamber 125. The applicator tip 115 is disposed at a first end of the stem 110. The base 105 is configured to secure the stem 110 at a second end of the stem 110. The handle 120 is coupled to the chamber 125 and the handle 120 and the chamber 125 can be independently rotated in relation to one another. That is, the user may hold the handle 120 and rotate the chamber 125, and vice versa. Furthermore, the chamber 125 is hollow and configured to receive the base 105. As shown, the handle 120, the chamber 125, and the base 105 have a cylindrical shape, but it may be appreciated that other cross-sectional shapes can be used, such as, in a non-limiting example, triangular, rectangular, pentagonal, hexagonal, octagonal, etc. An exterior surface of the handle 120 and the chamber 125 (FIG. 3C) can be smooth, textured, multi-faceted, etc. Importantly, said features do not hinder or impede the rotational coupling of the handle 120 and the chamber 125 (and as described below, the base 105 in the chamber 125 and thus the rotation of the base 105 relative to the handle 120).

The base 105 is fabricated from a polymer or a metal. The stem 110 is fabricated from a polymer, a fibrous material, or a metal. The applicator tip 115 can be formed as a flocked tip with bristles, a sponge-like tip, or a brush. The applicator tip 115 is configured to contact a surface and spread a solution. For example, the applicator tip 115 is configured to spread lip gloss onto the user's lips. Notably, as previously described, the applicator tip 115 can be not symmetrical in shape. As shown in FIG. 1A, the applicator tip 115 is curved and provides a larger surface area along one side of the applicator tip 115 for the user to more easily spread the lip gloss over the user's lips.

Concomitantly, this introduces a directional preference during application, which can be difficult for users with reduced mobility and range of motion in their arms or hands to maintain. For example, it may be challenging for the user with limited arm/hand mobility to maintain an optimal angle for the applicator tip 115 while sweeping over the user's lips from one side to another (i.e. cheek to cheek). In another example, more simply, it may be challenging for the user with limited arm/hand mobility to pick up the adjustable cosmetic applicator 100 and manipulate it to the optimal angle at all.

Figure 1B:
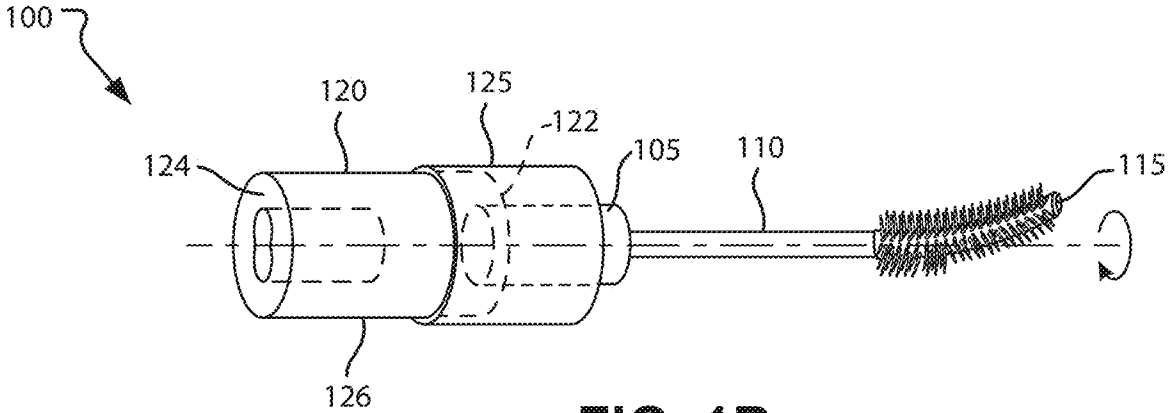
FIG. 1B is a schematic of the adjustable cosmetic applicator with the base coupled to the chamber, according to an embodiment of the present disclosure.
Figure 1C:
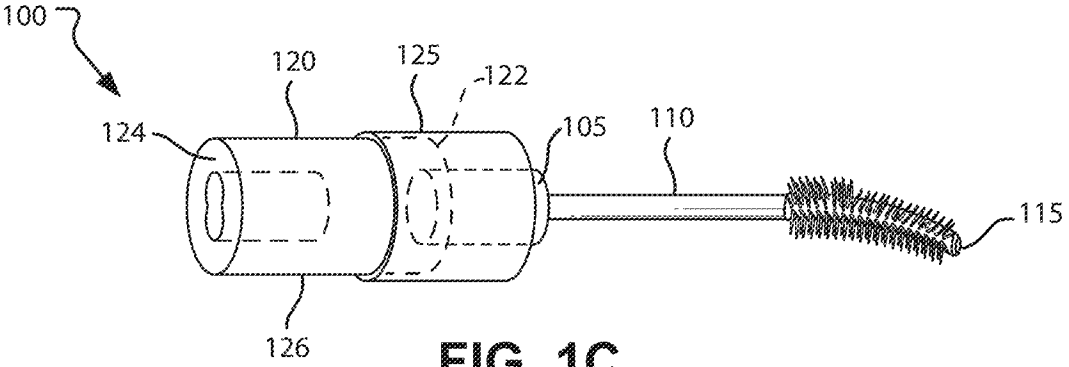
FIG. 1C is a schematic of the adjustable cosmetic applicator with the base coupled to the chamber, according to an embodiment of the present disclosure.

To this end, FIG. 1B and FIG. 1C are schematics of the adjustable cosmetic applicator 100 with the base 105 coupled to the chamber 125, according to an embodiment of the present disclosure. In an embodiment, the chamber 125 can be configured to receive the base 105 in the hollow portion of the chamber 125. Therefore, an exterior of the base 105 can have a shape and dimensions complementary to the hollow portion of the chamber 125 to provide a secure coupling of the base 105 to the chamber 125. For example, an outer diameter of the base 105 having a cylindrical shape (as shown) can be equal to or slightly less than an inner diameter of the chamber 125. For example, a cross-sectional shape of the base 105 can be square and have a side length equal to or slightly less than a side length of a square cross-sectional shape of the hollow portion of the chamber 125.

Furthermore, upon the chamber 125 receiving the base 105, the base 105 can also, by extension, be rotateably coupled to the handle 120. That is, by rotating the chamber 125, the base 105 also rotates relative to the handle 120. As shown in FIG. 1B and FIG. 1C, a 180 degree rotation of the chamber 125 can rotate the base 105 by the same angle, thus flipping the curved applicator tip 115 orientation. This adjustable rotation angle of the applicator tip 115 relative to the handle 120 provides an advantage by i) allowing the user with limited arm/hand mobility to rotate the applicator tip 115 at all, and ii) allowing the user with limited arm/hand mobility to adjust the rotation angle of the applicator tip 115 without having to rotate the entirety of the adjustable cosmetic applicator 100. Importantly, this can be performed without needing to release the entire adjustable cosmetic applicator 100. That is, the user can grip the handle 120 with a portion of their hand, while one or two fingers can manipulate the chamber 125 to rotate the applicator tip 115. For the user with limited arm/hand mobility, this can provide easier on-the-fly adjustment of the applicator tip 115.

In an example, the user may rotate the chamber 125 and the applicator tip 115 to a first angle to apply lip gloss to one half of their bottom lip, and the bottom lip can generally have a first broad surface with a first planar angle and a second broad surface with a second planar angle. For example, the first broad surface is the user's right side of their bottom lip, and the second broad surface is the user's left side of their bottom lip. Therefore, assuming a plane tangent to the curvature of the user's lips at the center of the user's lips is at 0 degrees, the first planar angle of the first broad surface can be +10 degrees relative to the tangent plane at the center of the user's lip curvature, while the second planar angle of the second broad surface can be −10 degrees relative to the tangent plane. As such, the applicator tip 115 can be set initially to coat the first broad surface of the user's lips, but then the applicator tip 115 would not be in an optimal angle to coat the second broad surface of the user's lips. Therefore, the user could easily rotate the chamber 125 and the applicator tip 115 20 degrees to the second planar angle and match with the second broad surface in order to apply the lip gloss. In this example, a rotation axis of the chamber 125 and the applicator tip 115 is not parallel to a long dimension of the users lips.

Additionally, the rotation of the chamber 125 and the applicator tip 115 can be reversibly locked. To this end, FIGS. 2A-2D are schematics of detents, according to an embodiment of the present disclosure. In an embodiment, a first end of the handle 120 includes a plurality of detents 199 along a first surface, wherein the first surface of the handle 120 faces the chamber 125 and the base 105. For example, the first surface of the handle 120 can be flush with the base 105 at least along a portion where the plurality of detents 199 are disposed. The plurality of detents 199 can be arranged in a ring or radially relative to a center of the first surface through which a rotation axis of the adjustable cosmetic applicator 100 passes, wherein the rotation axis is orthogonal to a plane of the first surface.

Figure 2A:
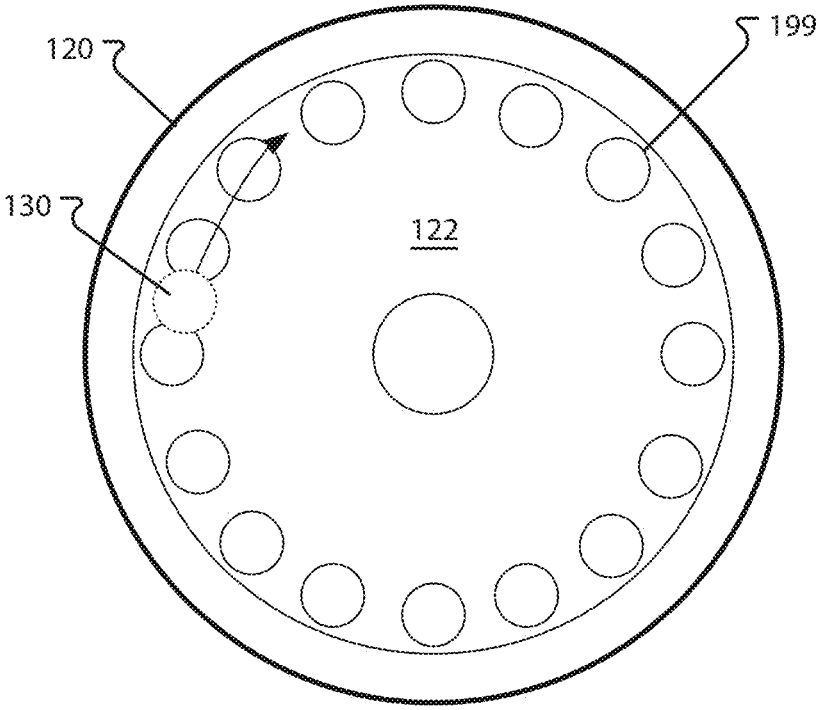
FIG. 2A is a schematic of the plurality of detents having a circular cross-sectional shape, according to an embodiment of the present disclosure.
Figure 2B:
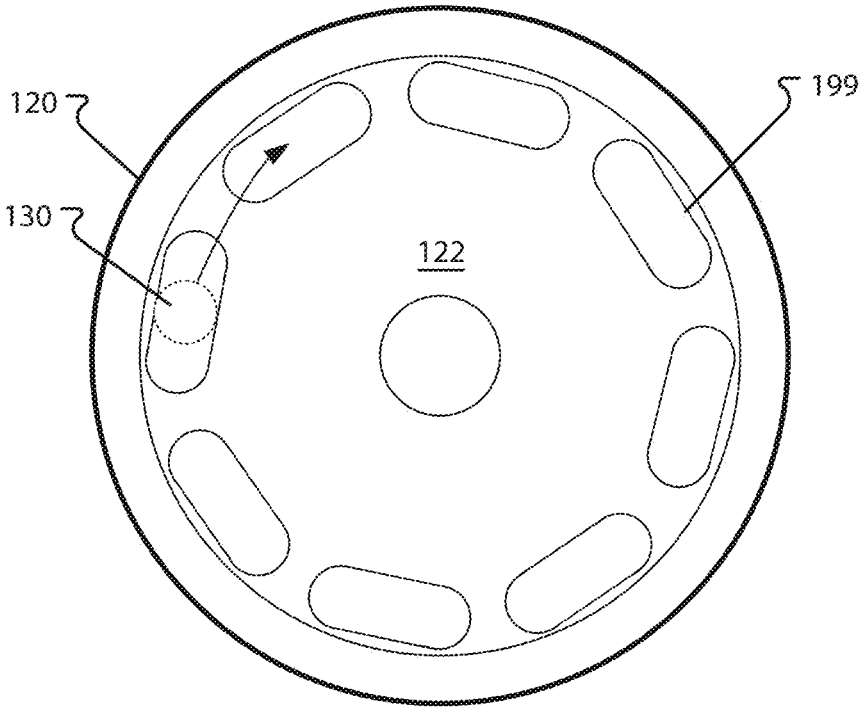
FIG. 2B is a schematic of the plurality of detents having a rounded rectangular cross-setional shape, according to an embodiment of the present disclosure.
Figure 3A:
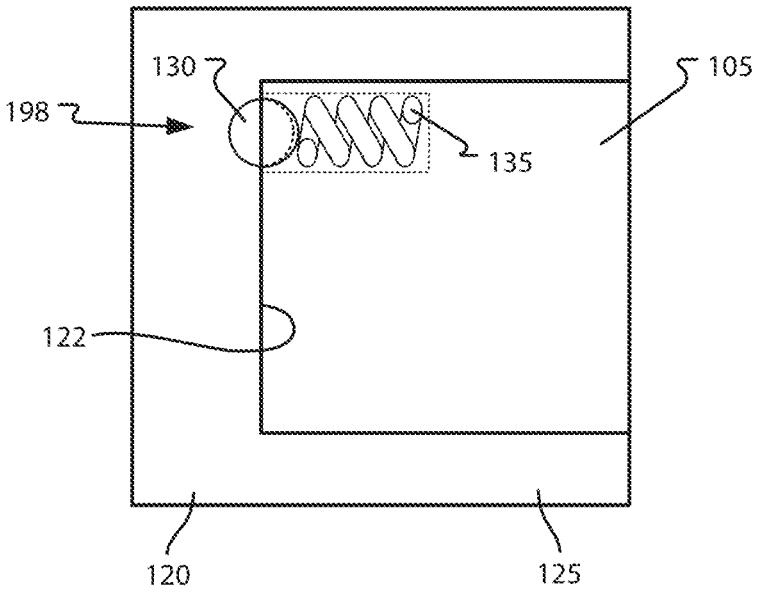
FIG. 3A is a schematic of the base including a locking device, according to an embodiment of the present disclosure.

FIG. 2A is a schematic of the plurality of detents 199 having a circular cross-sectional shape, according to an embodiment of the present disclosure. FIG. 2B is a schematic of the plurality of detents 199 having a rounded rectangular cross-setional shape, according to an embodiment of the present disclosure. Referring to FIG. 3A, FIG. 3A is a schematic of the base 105 including a locking device 198, according to an embodiment of the present disclosure. In an embodiment, the locking device 198 includes a ball 130 and a spring 135. The ball 130 and the spring 135 are disposed in a tube formed in the base 105, wherein the spring 135 is disposed between the ball 130 and an end of the tube. Thus, the spring 135 is under compression by the ball 130 and applies a force on the ball 130 away from the base 105 and along the rotation axis when the base 105 is coupled with the chamber 125. Referring again to FIG. 2A and 2B, when the base 105 is coupled with the chamber 125 and sits flush against the first surface 122 of the handle 120, the ball 130 is either forced further into the tube when the ball 130 contacts a space between two detents of the plurality of detents 199, or the ball 130 is forced into any one detent of the plurality of detents 199 by the spring 135 as the chamber 125 is rotated. Upon rotating the chamber 125 and the base 105, when the ball 130 is disposed between the two detents of the plurality of detents 199, the ball 130 rolls without obstacle until reaching said any one detent of the plurality of detents 199. Upon reaching said any one detent of the plurality of detents 199, the ball 130 is forced into said any one detent of the plurality of detents 199 and the rotational motion of the chamber 125 and the base 105 is arrested.

In an embodiment, a stiffness of the spring 135 and the shape of said any one detent of the plurality of detents 199 determines the resistance to continue rotating the chamber 125. A high stiffness spring 135 can keep the ball 130 pressed harder into the any one detent of the plurality of detents 199, thus preventing the ball 130 from egressing out and freeing the chamber 125 to rotate. For a lower stiffness spring 135, the rotation of the chamber 125 can force the ball 130 to compress the spring 135 and allow the ball 130 to retract into the tube easier, thus freeing the chamber 125 to rotate faster. For example, the stiffness the spring 135 can correlate to a torque needed to rotate the applicator tip 115 between 0.1 and 10 N-m.

For a shape of the any one detent of the plurality of detents 199 being hemispherical to match a shape of the ball 130 (i.e. spherical), the force needed for the ball 130 to egress can be at a maximum. Instead, in a non-limiting example, the shape can be circular pyramidal, wherein sidewalls of the plurality of detents 199 are linear. Thus, for such a shape, the ball 130 does not sit fully in the any one detent of the plurality of detents 199 and the resistance to forcing the ball 130 out is lower than for the hemispherical shape (see FIG. 2D for an example cross-section). Furthermore, for FIG. 2A, the ball 130 sits in the any one detent of the plurality of detents 199 and locks the chamber 125 at the exact location of the detent in question. This does not provide any room for error for the user while rotating the chamber 125 to adjust the applicator tip 115.

Instead, referring to FIG. 2B, the elongated, rectangular shape of the any one detent of the plurality of detents 199 can allow the ball 130 to move while in the any one detent of the plurality of detents 199. While shown as having straight side lengths in FIG. 2B, it may be appreciated that the rounded rectangular shape can actually have somewhat curved side lengths to follow the radial rotation pattern the ball 130 traces as the chamber 125 and the base 105 are rotated. As the user rotates the chamber 125 and the base 105, the ball 130 locks into the any one detent of the plurality of detents 199 and can allow the chamber 125 and the base 105 to rotate further between a first end and a second end of the any one detent of the plurality of detents 199. This rotational tolerance can afford the user some margin for error while setting the angle of the applicator tip 115 and even "self-adjust" as the user sweeps the applicator tip 115 across their skin. In the example of the lip gloss applicator, the rotational tolerance afforded to the user can be sufficient to sweep between the first broad surface and the second broad surface of the user's lips. That is, the rotational tolerance can allow for 20 degrees of rotation (of the chamber 125, the base 105, and the applicator tip 115) between the first end and the second end of the rectangular shape of the any one detent of the plurality of detents 199. Based on the limitations of a particular user's arm/hand mobility, this rotational tolerance can be adjusted by extending or shortening the side length of the rectangular shape of the any one detent of the plurality of detents 199. In such a way, the user does not need to further r rotate the chamber 125 at all while applying the lip gloss to the bottom lip and only needs to adjust the adjustable cosmetic applicator 100 once for the bottom lip.

Figure 2C:
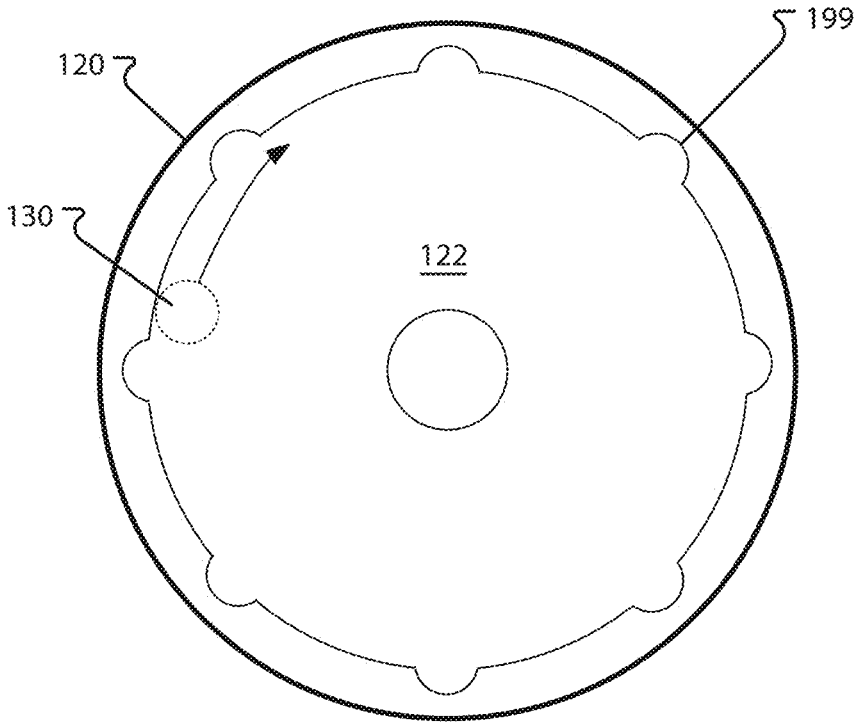
FIG. 2C is a cross-sectional schematic of sidewall detents having a hemispherical shape, according to an embodiment of the present disclosure.
Figure 2D:
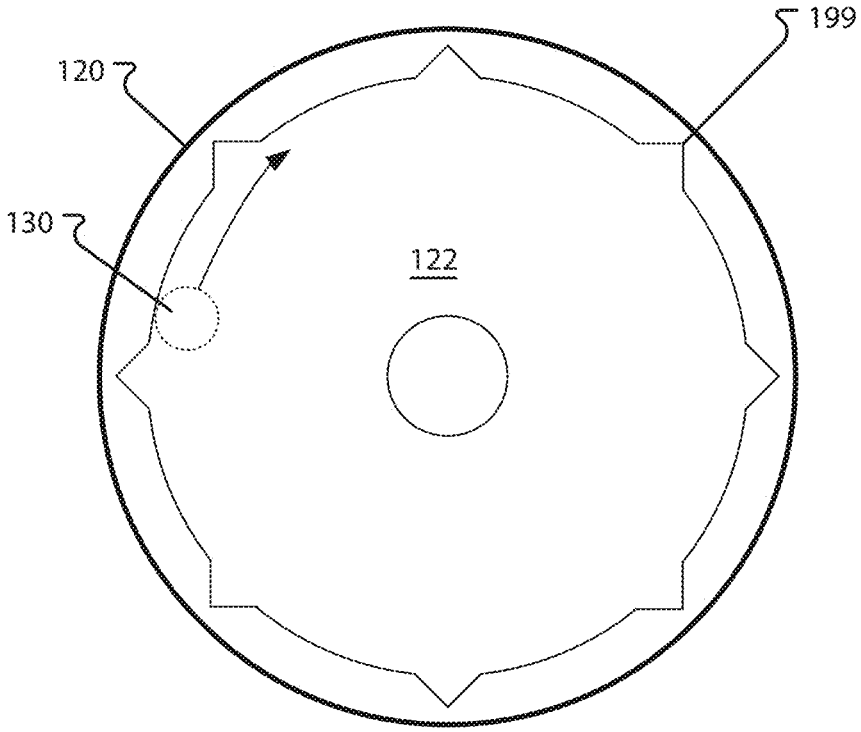
FIG. 2D is a cross-sectional schematic of sidewall detents having a circular pyramidal shape, according to an embodiment of the present disclosure.
Figure 3B:
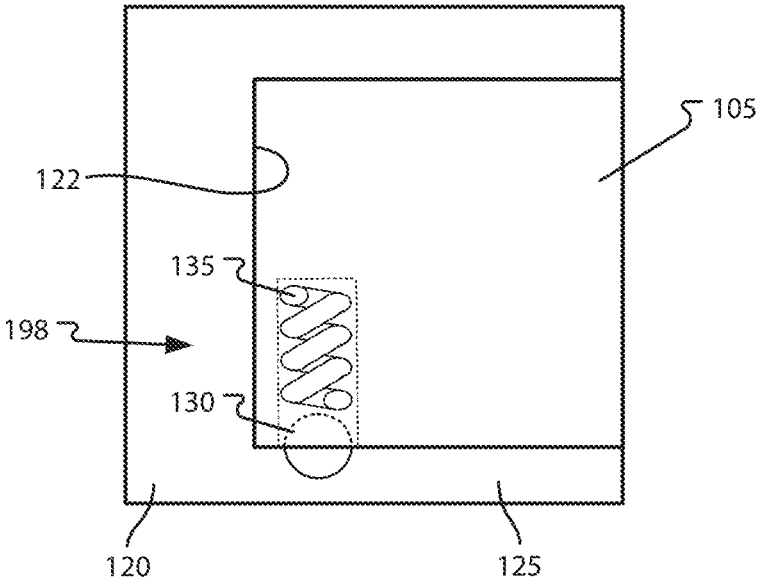
FIG. 3B is a schematic of the base including a locking device oriented orthogonal to the locking device of FIG. 3A, according to an embodiment of the present disclosure.

FIG. 2C is a cross-sectional schematic of sidewall detents having a hemispherical shape, according to an embodiment of the present disclosure. FIG. 2D is a cross-sectional schematic of sidewall detents having a circular pyramidal shape, according to an embodiment of the present disclosure. In an embodiment, the first surface 122 of the handle 120 is entirely recessed into the handle 120 to form a hollow cavity including sidewalls along a periphery of the hollow cavity. As shown, the plurality of detents 199 can be formed in the sidewalls of the hollow cavity. Again, the shape of the any one detent of the plurality of detents 199 can be hemispherical (FIG. 2C) or circular pyramidal (FIG. 2D). Referring to FIG. 3B, FIG. 3B is a schematic of the base 105 including the locking device 198 oriented orthogonal to the locking device 198 of FIG. 3A, according to an embodiment of the present disclosure. That is, the locking device 198 in FIG. 3B is oriented to be orthogonal to the rotation axis when the base 105 is coupled with the chamber 125. In such a way, the ball 130 is pushed into the sidewall of the hollow cavity of the handle 120 in FIG. 2C and 2D.

Similarly, as the chamber 125 is rotated, the ball 130 rolls along the sidewall until reaching the any one detent of the plurality of detents 199, whereupon the ball 130 will be forced into the any one detent of the plurality of detents 199 by the spring 135 to lock the rotation of the chamber 125 and the base 105. It may be appreciated that, although not shown, the rectangular shape of the any one detent of the plurality of detents 199 can be applied to FIG. 2C and 2D as well to provide additional rotational tolerance. It may be additionally appreciated that any shape for the any one detent of the plurality of detents 199 can be used to lock the ball 130 based on a desired resistance to unlocking the rotation of the chamber 125 and the base 105. It may be also appreciated that the locking device 198 can include, instead of the ball 130, a locking tab or pin that is forced into the any one detent of the plurality of detents 199. For example, a locking pin can have a pointed tip and be pushed in via the spring 135. For example, a locking tab can be formed of a sufficiently flexible material, such as a polymer, and be deflected sideways while in the space between the detents while being rotated, and upon reaching the any one detent of the plurality of detents, the locking tab can fully extend (i.e. not be deflected as much) and a tip of the locking tab can sit inside the any one detent of the plurality of detents 199.

Figure 3C:
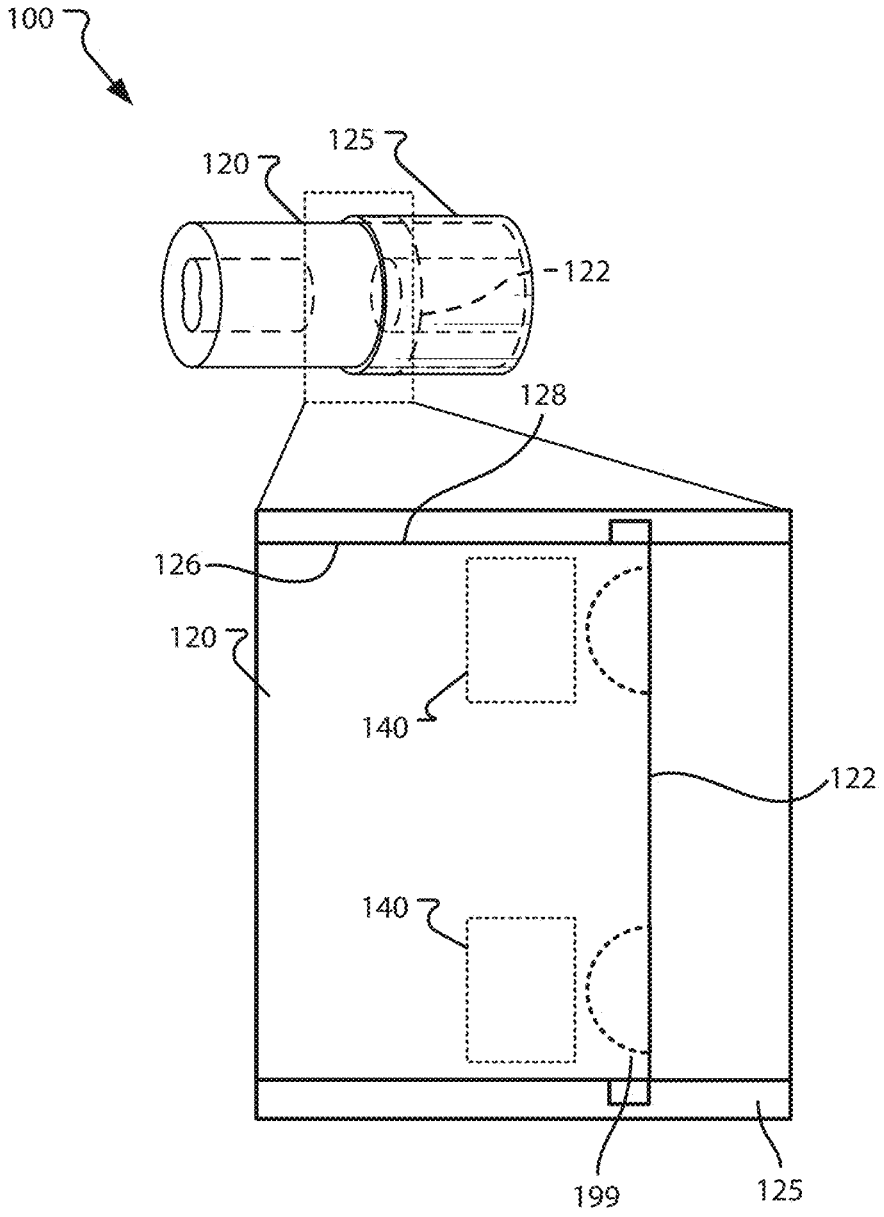
FIG. 3C is a cross-sectional schematic of a magnetic locking device, according to an embodiment of the present disclosure.

FIG. 3C is a cross-sectional schematic of a magnetic locking device, according to an embodiment of the present disclosure. In an embodiment, the handle 120 includes the plurality of detents 199 disposed on the first surface 122 of the handle 120 similar to that of FIG. 2A and 2B. As shown in FIG. 3C, the handle 120 further includes a magnet 140 disposed adjacent to each detent of the plurality of detents 199 on a side of the detent opposite where the ball 130 would sit, and the locking mechanism 198 does not need the spring 135. Instead, as the chamber 125 and the base 105 rotate, upon the ball 130 meeting the any one detent of the plurality of detents 199, a material of the ball 130 can be magnetic and the ball 130 is pulled into the any one detent of the plurality of detents 199 via a magnetic force of the magnet 140. Here, the ball 130 can be retained based on the strength of the magnetic force of the magnet 40. As the chamber 125 and the base 105 are rotated, the ball 130 overcomes the magnetic force to egress, and subsequently retracts into the tube and is free to roll with the rotation of the chamber 125 and the base 105.

Figure 1D:
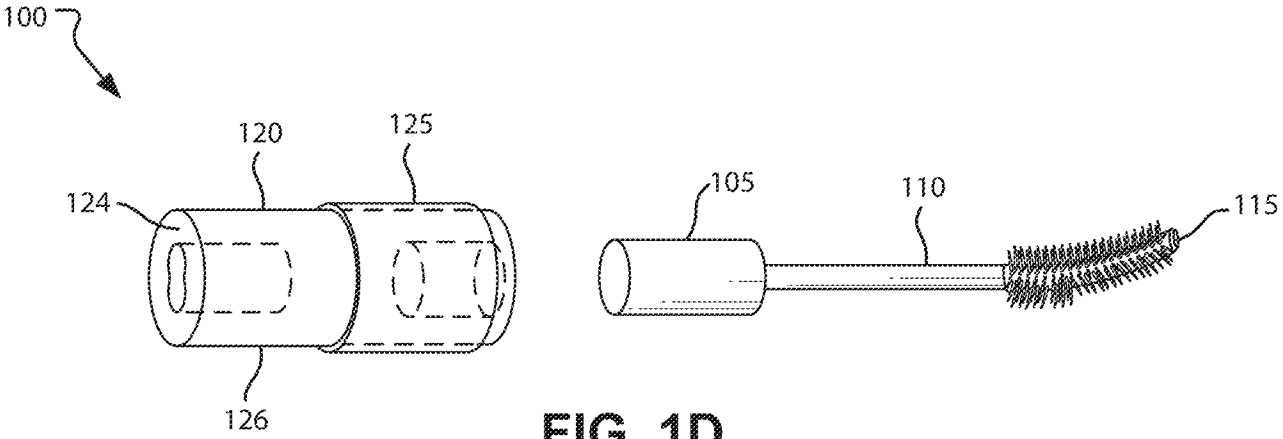
FIG. 1D is a schematic of the adjustable cosmetic applicator 100, according to an embodiment of the present disclosure.

FIG. 1D is a schematic of the adjustable cosmetic applicator 100, according to an embodiment of the present disclosure. In an embodiment, the chamber 125 is completely hollow and the handle 120 passes entirely through the chamber 125, and the handle 120 includes a hollow cavity configured to receive the base 105. That is, the chamber 125 is rotateably coupled to an exterior of the handle 120. Here, rotating the handle 120 with the base 105 coupled to the handle 120 will rotate the base 105 and thus adjust the applicator tip 115. Therefore, to rotate the handle 120 and the base 105 relative to the chamber 125, the user can grip the chamber 125 and spin the handle 120.

Figure 2E:
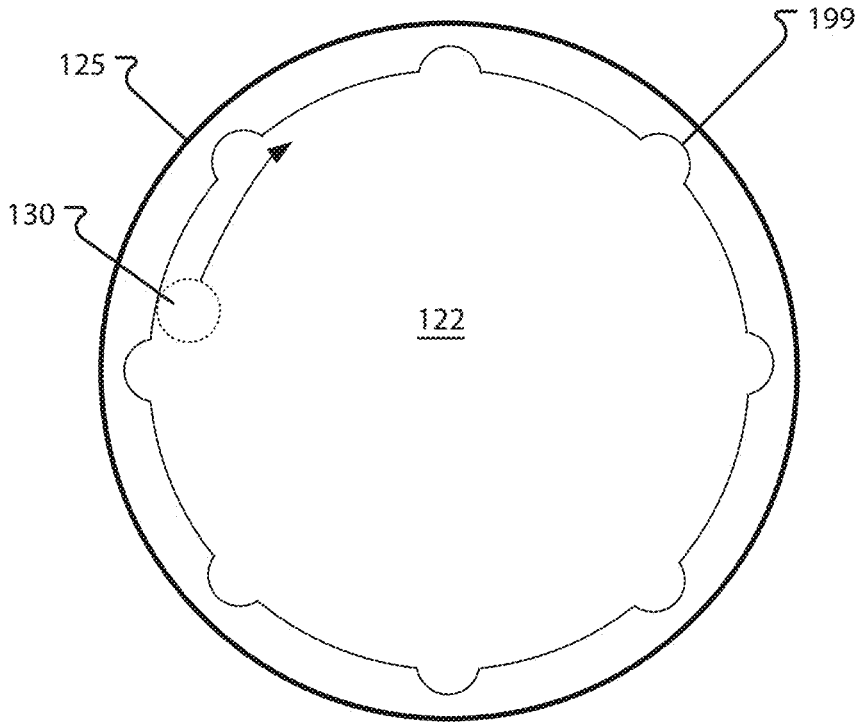
FIG. 2E is a cross-sectional schematic of the chamber for the embodiment of FIG. 1D, according to an embodiment of the present disclosure.
Figure 3D:
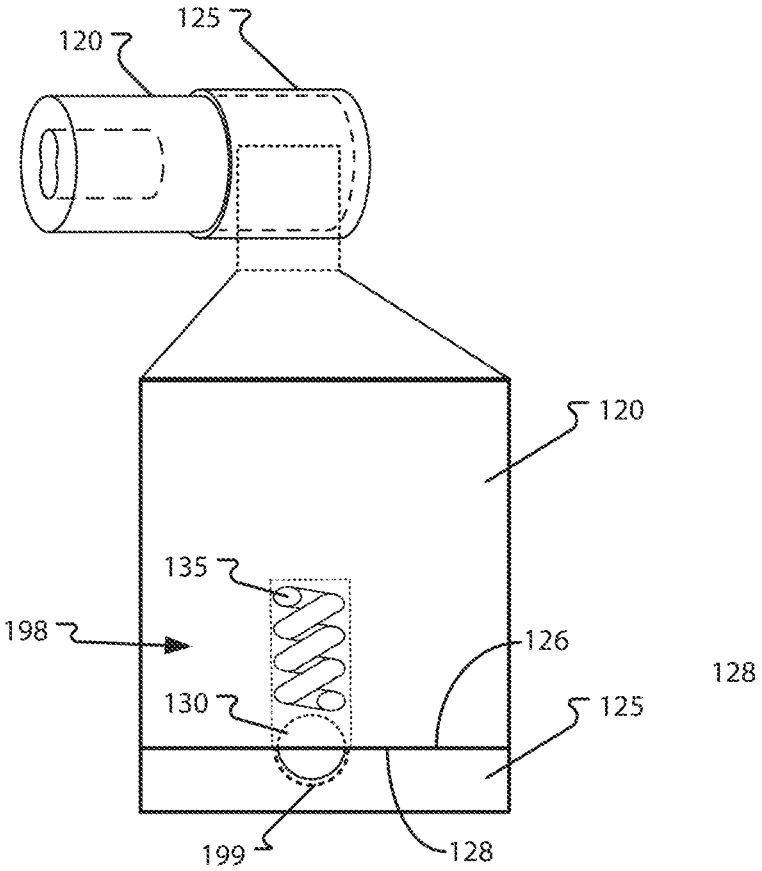
FIG. 3D is a schematic of the locking mechanism for the embodiment of FIG. 1D, according to an embodiment of the present disclosure.

FIG. 2E is a cross-sectional schematic of the chamber 125 for the embodiment of FIG. 1D, according to an embodiment of the present disclosure. In an embodiment, the plurality of detents 199 are disposed along a sidewall of the completely hollow chamber 125. Referring to FIG. 3D, FIG. 3D is a schematic of the locking mechanism for the embodiment of FIG. 1D, according to an embodiment of the present disclosure. In an embodiment, the locking mechanism 198 is disposed in the handle 120 and oriented orthogonal to the rotation axis. The non-limiting example of the locking mechanism 198 including the ball 130 and the spring 135 is shown, but it may be appreciated that the example including the magnet 140 (which would be disposed in the chamber 125 instead) and excluding the spring 135 can be implemented in this embodiment as well. As such, the chamber 125 can be disposed along an exterior of the handle 120 where the locking mechanism 198 is disposed. Here, as the handle 120 is rotated by the user, the ball 130 in the handle 120 rolls along the sidewall of the chamber 125 until reaching the any one detent of the plurality of detents 199 in the sidewall of the chamber 125, whereupon the ball 130 will similarly roll into the any one detent of the plurality of detents 199 and lock the handle 120 from rotating relative to the chamber 125 any further.

Figure 4A:
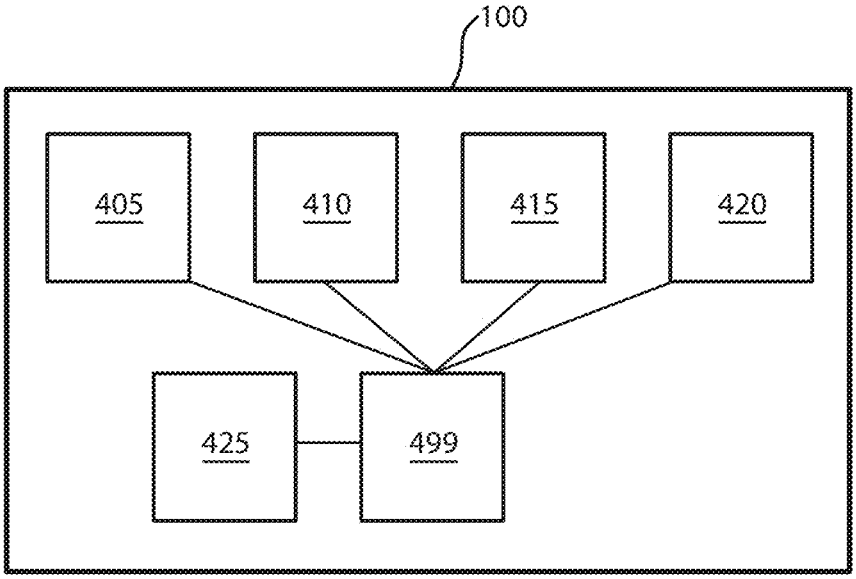
FIG. 4A is an exemplary block diagram of an adjustable cosmetic applicator system, according to an embodiment of the present disclosure.

FIG. 4A is an exemplary block diagram of an adjustable cosmetic applicator 100 system, according to an embodiment of the present disclosure. For example, in an embodiment, the adjustable cosmetic applicator 100 includes a speech input device 410, an audio input device 415, a video input device 420, a tactile input device 425, or combinations thereof. In an embodiment, the adjustable cosmetic applicator 100 is configured to displace the applicator tip 115 about one or more axes, such as the rotation axis, responsive to one or more audio inputs, gesture inputs, or the like. In an embodiment, the adjustable cosmetic applicator 100 includes a motor 405 operably coupled to processing circuitry 499 including one or more of the speech input device 410 configured to enable voice control, voice commands, verbal input, or the like. In an embodiment, the adjustable cosmetic applicator 100 includes the motor 405 operably coupled to the processing circuitry 499 including one or more of the acoustic audio input device 415 configured to enable voice control, voice commands, verbal input, or the like. In an embodiment, the adjustable cosmetic applicator 100 includes the motor 405 operably coupled to the processing circuitry 499 including one or more of the video input device 420 configured to enable gesture control, visual cue control, or the like. In an embodiment, the adjustable cosmetic applicator 100 includes the motor 405 operably coupled to the processing circuitry 499 including one or more of the tactile input device 425 configured to enable tactile input control (e.g. tapping), pressure-based input control, or the like.

Figure 4B:
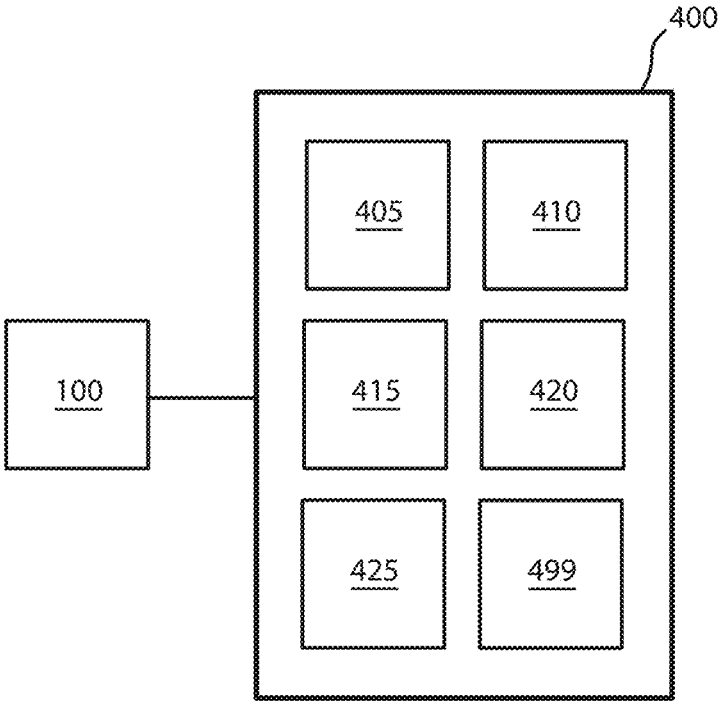
FIG. 4B is an exemplary block diagram of an adjustable cosmetic applicator system, according to an embodiment of the present disclosure.

It may be appreciated that a second surface 124 of the handle 120 at a second end of the handle 120 can include an orifice for receiving a rotating mechanism, such as a rod connected to the motor 405. To this end, FIG. 4B is an exemplary block diagram of the adjustable cosmetic applicator 100 system, according to an embodiment of the present disclosure. In an embodiment, the motor 405 can be formed as part of a grip device 400 designed for improving ease of handling and range of motion for the user with limited arm/hand mobility. Additionally, the speech input device 410, the audio input device 415, the video input device 420, the tactile input device 425, the processing circuitry 499, or any combination thereof, can be included in the grip device. Thus, the adjustable cosmetic applicator 100 can be coupled to the grip device 400 and the motor 405 to provide another mechanism for displacing the applicator tip 115. For example, the user can press a first button on the grip device 400 to actuate the motor 405 to rotate the handle 120 in a first direction, and the user can press a second button on the grip device 400 to actuate the motor 405 to rotate the handle 120 in a second direction. The grip device 400 can include the processing circuitry 499 and stabilizing devices, such as a gyroscope, to automatically maintain yaw, pitch, and roll angles of the adjustable cosmetic applicator 100 to further improve the ease of use for the user applying the cosmetic fluid via the adjustable cosmetic applicator 100. An example of a grip device 400 is described in U.S. patent application Ser. No. 16/133,969, incorporated herein by reference in its entirety.

The description above in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one aspect", "one embodiment", "an aspect", or "an embodiment" means that a particular feature, structure, characteristic, operation, or function described in connection with an embodiment is included in at least one embodiment of the disclosed subject matter. Thus, any appearance of the phrases "one aspect", "one embodiment", "an aspect", or "an embodiment" in the specification is not necessarily referring to the same aspect or embodiment. Further, the particular features, structures, characteristics, operations, or functions may be combined in any suitable manner in one or more aspects or embodiments. Further, it is intended that aspects or embodiments of the disclosed subject matter can and do cover modifications and variations of the described aspects or embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear,"

"side," "interior," "exterior," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

A number of embodiments have been described. Nevertheless, it will be understood that various modifications are made without departing from the spirit and scope of this disclosure. For example, preferable results are achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. An adjustable cosmetic applicator, comprising:

a stem;

an applicator tip attached to a first end of the stem;

a base attached to a second end of the stem, the base including a locking device disposed at a first end of the base, the locking device including a ball;

a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, the applicator tip rotates and is forced in one of a plurality of rotational positions corresponding to the ball falling into one of the plurality of detents, wherein the chamber and the handle are configured to rotate independently around a rotation axis through a center of the chamber and the handle, wherein the handle includes a first surface at the first end of the handle and the plurality of detents are disposed on the first surface, the base includes a hollow tube having a longitudinal axis oriented parallel to the rotation axis and an opening in the hollow tube aligns with the plurality of detents during rotation of the chamber, the locking device includes a spring disposed between the ball and a closed end of the hollow tube in the base, and the ball of the locking device abuts the first surface of the handle.

2. The adjustable cosmetic applicator of claim 1. wherein each detent of the plurality of detents have a hemispherical shape complementary to the ball.

3. The adjustable cosmetic applicator of claim 1 wherein each detent of the plurality of detents have an elongated rectangular shape.

4. The adjustable cosmetic applicator of claim 3, wherein upon the ball falling into a first detent of the plurality of detents, the ball is configured to roll between a first end and a second of the first detent of the plurality of detents.

5. The adjustable cosmetic applicator of claim 1, wherein each detent of the plurality of detents have a circular pyramidal shape.

6. The adjustable cosmetic applicator of claim 1 wherein the plurality of detents are arranged in an annular pattern around the center of the handle on the first surface of the handle.

7. The adjustable cosmetic applicator of claim 1, wherein the applicator tip is asymmetrical.

8. An adjustable cosmetic applicator, comprising:

a stem;

an applicator tip attached to a first end of the stem;

a base attached to a second end of the stem, the base including a locking device disposed at a first end of the base, the locking device including a ball;

a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, the applicator tip rotates and is forced in one of a plurality of rotational positions corresponding to the ball falling into one of the plurality of detents, wherein the chamber and the handle are configured to rotate independently around a rotation axis through a center of the chamber and the handle;

a grip device, including:

a motor operably coupled to processing circuitry, wherein the motor is coupled to a second surface at a second end of the handle; and a speech input device, wherein the processing circuitry is configured to enable voice control, voice commands, and verbal input, and upon the processing circuitry detecting an input via the speech input device, actuating the motor.

9. An adjustable cosmetic applicator comprising:

a stem;

an applicator tip attached to a first end of the stem;

a base attached to a second end of the stem, the base including a locking device disposed at a first end of the base, the locking device including a ball;

a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, the applicator tip rotates and is forced in one of a plurality of rotational positions corresponding to the ball falling into one of the plurality of detents, wherein the chamber and the handle are configured to rotate independently around a rotation axis through a center of the chamber and the handle;

a grip device, including:

a motor operably coupled to processing circuitry, wherein the motor is coupled to a second surface at a second end of the handle; and an acoustic audio input device, wherein the processing circuitry is configured to enable voice control, voice commands, and verbal input, and upon the processing circuitry detecting an input via the acoustic audio input device, actuating the motor.

10. An adjustable cosmetic applicator of comprising:

a stem;

an applicator tip attached to a first end of the stem;

a base attached to a second end of the stem, the base including a locking device disposed at a first end of the base, the locking device including a ball;

a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, the applicator tip rotates and is forced in one of a plurality of rotational positions corresponding to the ball falling into one of the plurality of detents, wherein the chamber and the handle are configured to rotate independently around a rotation axis through a center of the chamber and the handle;

a grip device, including:

a motor operably coupled to processing circuitry, wherein the motor is coupled to a second surface at a second end of the handle; and a video input device, wherein the processing circuitry is configured to enable gesture control and visual cue control, and upon the processing circuitry detecting an input via the video input device, actuating the motor.

11. An adjustable cosmetic applicator comprising:

a stem;

an applicator tip attached to a first end of the stem;

a base attached to a second end of the stem, the base including a locking device disposed at a first end of the base, the locking device including a ball;

a handle including a first end, the first end of the handle including a plurality of detents configured to receive the ball; and a chamber rotateably coupled to the handle, the chamber including a hollow cavity configured to receive the base inserted therein, the first end of the base being disposed proximal to the first end of the handle, the applicator tip rotates and is forced in one of a plurality of rotational positions corresponding to the ball falling into one of the plurality of detents, wherein the chamber and the handle are configured to rotate independently around a rotation axis through a center of the chamber and the handle;

a grip device, including:

a motor operably coupled to processing circuitry, wherein the motor is coupled to a second surface at a second end of the handle; and a tactile input device, wherein the processing circuitry is configured to enable tactile input control and pressure-based input control, and upon the processing circuitry detecting an input via the tactile input device, actuating the motor.

12. An adjustable cosmetic applicator, comprising:

a stem;

an applicator tip attached to a first end of the stem;

a base attached to a second end of the stem, the base including a locking device disposed at a first end of the base, the locking device including a ball;

a handle including a cylindrical exterior surface, the exterior surface of the handle including a plurality of detents configured to receive the ball; and a hollow chamber having a cylindrical interior surface, wherein the hollow chamber is inserted within the handle, wherein the interior surface of the hollow chamber is juxtaposed to the exterior surface of the handle, the hollow chamber is rotateably coupled to the exterior surface of the handle along a portion of the exterior surface including the plurality of detents, wherein the chamber and the handle are configured to rotate independently around a rotation axis through a center of the chamber and the handle, the applicator tip rotates and is forced in one of a plurality of rotational positions corresponding to the ball falling into one of the plurality of detents, wherein the applicator tip rotates together with the chamber.

* * * * *